US006571984B1

(12) United States Patent
Winesett

(10) Patent No.: US 6,571,984 B1
(45) Date of Patent: Jun. 3, 2003

(54) STORAGE AND LOADING SYSTEM FOR BAGS

(76) Inventor: Frank P. Winesett, P.O. Box 999, San Andreas, CA (US) 95249

( * ) Notice: Subject to any disclaimer, the term of this patent is extended or adjusted under 35 U.S.C. 154(b) by 0 days.

(21) Appl. No.: 09/865,937

(22) Filed: May 23, 2001

(51) Int. Cl.[7] ..... B65H 3/00
(52) U.S. Cl. ..... 221/36; 206/554
(58) Field of Search ..... 221/33, 36, 37, 221/38, 42, 63, 45, 47, 210, 259; 206/554, 494, 449

(56) References Cited

U.S. PATENT DOCUMENTS 4,044,919 A 8/1977 Olson
4,611,728 A 9/1986 Compton et al.
4,739,902 A * 4/1988 Joslyn et al. ..... 221/210
4,805,800 A * 2/1989 Nocek et al. ..... 206/554
5,197,630 A * 3/1993 Kirla ..... 221/210
5,269,423 A 12/1993 Nguyen
5,509,570 A 4/1996 De Matteis

* cited by examiner

*Primary Examiner*—Kenneth W. Noland
(74) *Attorney, Agent, or Firm*—Theodore J. Bielen, Jr.

(57) ABSTRACT

A storage and loading system for at least one bag utilizing a container having a wall portion which forms a chamber. At least one bag is stored in the chamber and is accessible through an aperture. A flange is rotatable held to the container at the aperture and rotates from a first nested position, relative to the container, to a second extended position. Location again downwardly from the extended position to the first position serves to support the bag through contact.

6 Claims, 3 Drawing Sheets

STORAGE AND LOADING SYSTEM FOR BAGS

BACKGROUND OF THE INVENTION

The present invention relates to a novel and useful storage and loading system for bags.

Bags of polymeric material have become prolific in modern society. Typically, plastic bags, known as "baggies" are sold in containers and dispensed by pulling the same through an aperture in the container until the bag is completely free of the same. An item, which typically can be a foodstuff, is placed in the bag which must be supported on a surface and then opened with a single hand. Normally, such loading of the contents into a plastic bag takes dexterity and often requires many implemental steps to finally achieve the result intended. At best, "three hands" are required to properly load items into a plastic bag.

Many devices have been proposed to dispense plastic bags singularly. For example, U.S. Pat. Nos. 4,805,800, 5,269,423, and 5,509,570 show dispensers for plastic bags in which plastic bags are stacked one on top of another and pulled through an orifice for use.

U.S. Pat. No. 4,611,728 shows a package of imbricate bags in which multiple bags are adhesively, but releasably, attached to adjacent bags. The container for the bags has a constricted opening to cause the mouth of each bag to open when it is removed.

U.S. Pat. No. 4,044,919 describes a thermal plastic bag dispensing assembly in which a carton is arranged to permit the withdraw of individual bags and permit the bag mouth to open for accessibility.

A system which permits the storage, dispensing, and loading of bags with a minimum of effort would be a notable advance in the packaging field.

BRIEF SUMMARY OF THE INVENTION

In accordance with the present invention a novel and useful system for the storage and loading of bags is herein provided.

The system of the present invention utilizes a container having a wall portion which forms a chamber for storing at least one bag, preferably a multiplicity of bags. The container includes an aperture through the wall for communicating with the chamber and for permitting at least one bag to egress from the chamber when pulled. The bags may be, stacked or placed within the container in a conventional manner to permit bags to be removed one at a time and yet allow access to the next succeeding bag which is retrieved by repeating the pulling process. The container may be formed of any rigid or semi-rigid material such as plastic, paper, and the like.

A flange is also found in the system of the present invention. The flange is rotatably held to the container such that it is positioned at the aperture to the same. The flange is capable of rotating from a first position, nested to the container and adjacent the stacked bags within the container, to a second position, extending outwardly from the aperture of the container. In addition, the flange may be positioned to rotate downwardly from the second position back to the first position and into contact with a bag upon extension of the bag from the chamber through the aperture. Notably, the flange is capable of contacting a portion of the bag to permit the user to maintain the bag in an open position by pulling on another portion of the bag. Items may be moved or slid along the flange into the open mouth of the bag in this position, allowing the loading of the bag to take place by only one person using both hands. After loading a bag the flange may be placed atop the stacked bags within the chamber of the container and be split into a movable or flexible portion and a relatively movable base portion which remains within the chamber of the container.

The container of the system of the present invention may also be used in conjunction with a hollow support. The hollow support would include an opening on one end thereof to permit the container to partially extend into the hollow support snuggly. Thus, the container would be held by the hollow support and rest on a surface. Items to be loaded into the bag may originate on the top of the hollow support and be moved across the same onto the top of the flange, and into the bag. The hollow support may also serve to store the container when not in use.

It may be apparent that a novel and useful storage and loading system for at least one bag has been hereinabove described.

It is therefore an object of the present invention to provide a system for storing and loading bags which is compact and is easily usable by a single person to place items within bags.

Another object of the present invention is to provide a storing and loading system for bags which is capable of dispensing a multiplicity of bags one at a time and also permits the opening of the bag and loading of contents into the same by a single person using both hands.

A further object of the present invention is to provide a storage and loading system for bags which may be employed with a support that may also be used as a preparation area.

Another object of the present invention is to provide storage and loading system for bags which may be easily transported and supported on a vertical surface for use.

The invention possesses other objects and advantages especially as concerns particular characteristics and features thereof which will become apparent as the specification continues.

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the invention will evolve from the following detailed description of the preferred embodiments thereof which should be referenced to the prior described drawings.

Figure 1:
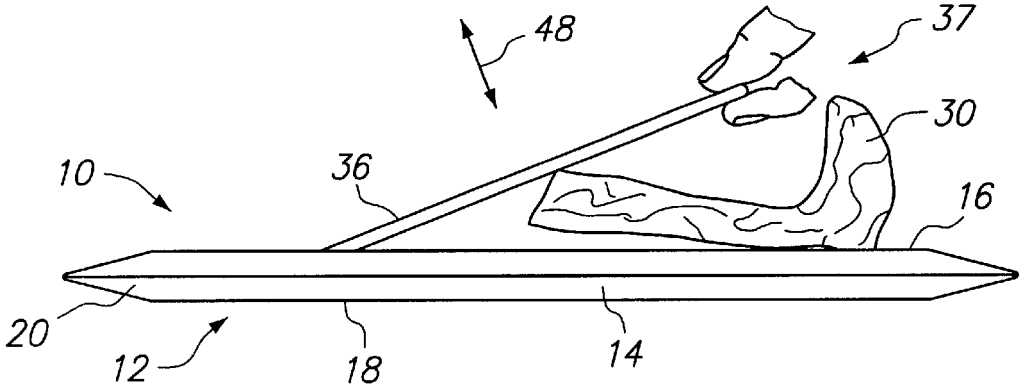
FIG. 1 is a side elevational view of the system of the present invention with the flange extended into its second position and with a single bag dispensed from the container.
Figure 2:
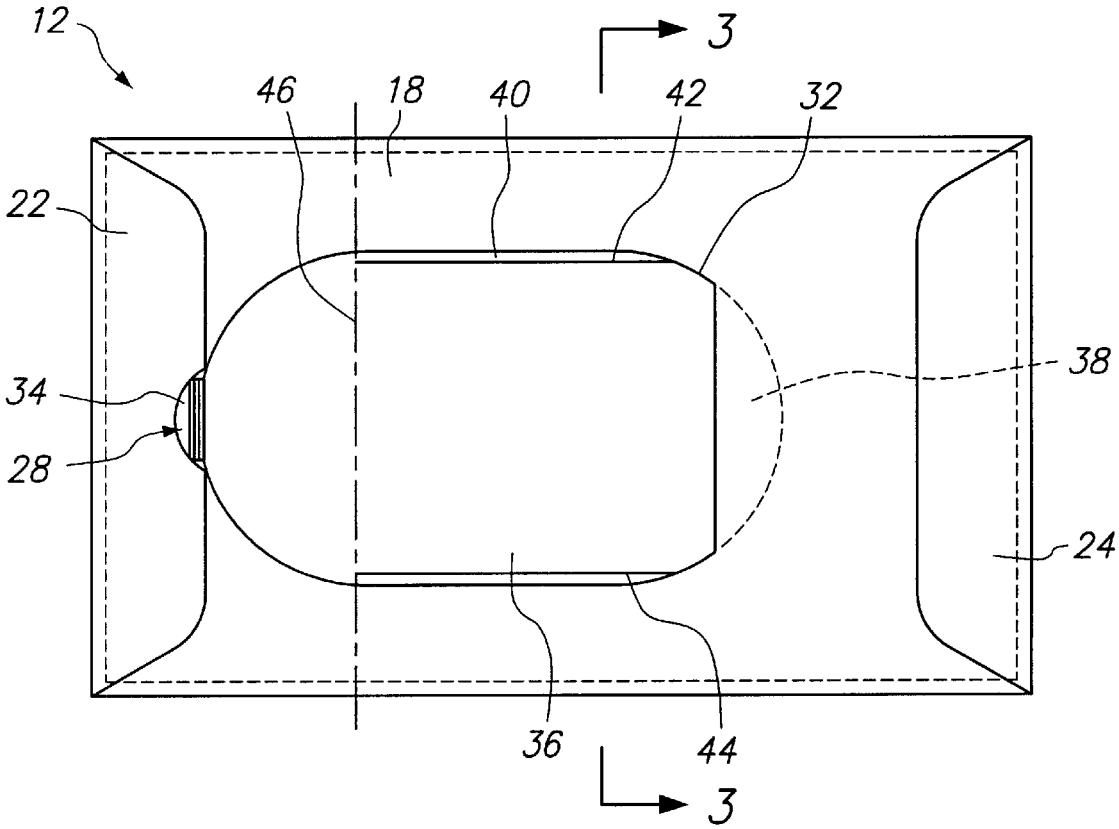
FIG. 2 is a top plan view of the system of the present invention with the flange tucked into the, aperture of the container and with a plurality of storage bags being stored within the container.
Figure 3:
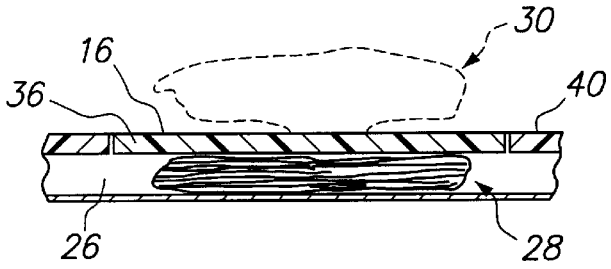
FIG. 3 is a sectional view taken along line 3—3 of FIG. 1 showing components in abbreviated configuration.

The invention as a whole is shown in the drawings by reference character 10. System 10 includes as one of its elements a container 12. Container 12 may be formed of any rigid, semi rigid, or flexible material. For example, container 12 may be formed of paper. As shown in the drawings, specifically FIGS. 1–3, container 12 includes a wall portion 14 which generally includes an upper side 16 and a lower side 18. In this regard, edge 20 of container 12 may be slightly rounded such that the line of demarcation between upper side 16 and lower side 18 is contiguous. Flaps 22 and 24 may also be used to enclose container 12 resulting in an inner chamber 26, FIG. 3. Inner chamber 26 may be employed to store plurality of plastic bags 28 which are stacked to permit dispensing of the same one at a time. FIG. 3 depicts a bag 30 which has emanated from aperture 32 of container 12. Aperture 32 permits the communication with chamber 26. Opening 34 through container permits the user to hang container 12 from a projection on a wall or other surface.

Flange or tongue 36 is also found in system 10 of the present invention. Flange 36 generally lies at aperture 32 and is generally oval shaped. It should be noted that a portion 38 of flange 36 tucks under side 18 of container 12 at a portion of aperture 32. Flange 36 is connected to a base member 40 which conforms to the outline of container 12 and supports flange 36 to container 12. Base member 40 is depicted in phantom in part. Base member 40 adds a degree of stiffness to container 12 opening 34 is also reinforced by a portion of base member 40 surrounding opening 34. Edges 42 and 44 represent a split between flange 36 and base member 40. Axis 46 coincides with the bending place of flange 36 relative to base 40 since both flange 36 and base 40 are flexible. Directional arrow 48, FIG. 1 indicates the rotation of flange 36 relative to surface 18 and aperture 32 of container 12. Fingers 37 depict a typical grip for achieving rotation of flange 36.

Figure 5:
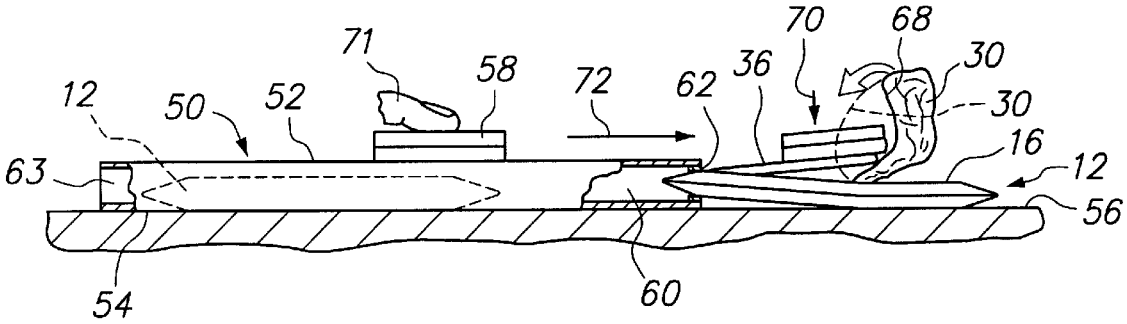
FIG. 5 is a side elevational view of the system of the present invention depicting the container being held by a support and showing an item being loaded into the bag along the top of the flange.
Figure 6:
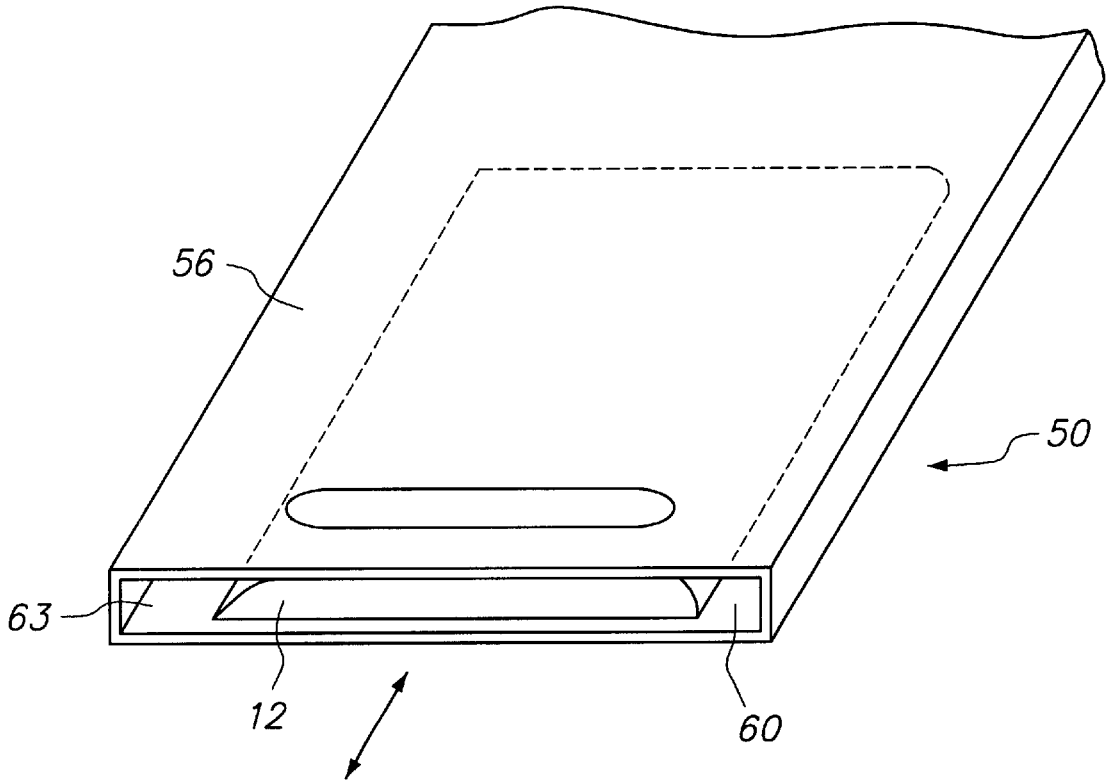
FIG. 6 is a top, left, perspective view of the support holding the container therewithin.

With reference to FIGS. 5 and 6, it may be observed that system 10 may also include a support 50 having an upper side 52 and a lower side 54 intended to contact a foundation surface 56. Foundation surface 56 may take the form of a counter, a tabletop, and the like. In any case, upper side 52 of support 50 may be used as a preparation surface for an item such as sandwich 58. Support 52 may be hollow and include a chamber 60 having a restricted opening 62 thereto. Container 12 would be sized to wedge within opening 62 and be held thereby is depicted in FIG. 5 to surface 56. In addition, container 12 may be stored within chamber 60, when not in use, via large opening 63, best shown in FIG. 6. Container 12 may be retrieved from chamber 60 by simply tipping support 50 upwardly to orient opening 63 downwardly.

Figure 4:
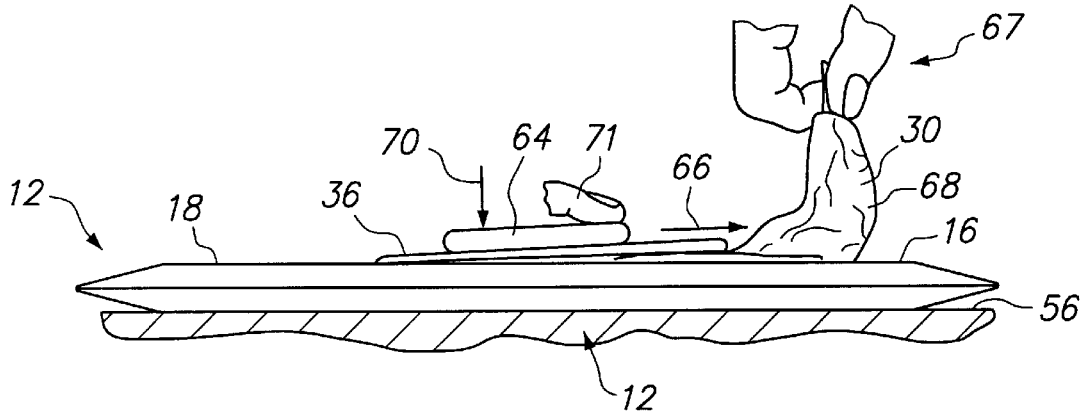
FIG. 4 is a side elevational view of the system of the present invention in which the flange has been lowered to its first position and engages a portion of a bag.

In operation, the user places container 12 on a surface 56, FIG. 4. Item 64 is slid along flange 36 according to directional arrow 66. Bag 30 is partially pulled from chamber 26 of container 12 such that mouth 68 is open toward item 66. Hand and fingers 67 illustrate such movement of bag 30. The user then moves item 64 along flange 36, and also exerts a degree of pressure, indicated by directional arrow 70, and finger 71 on item 64 and flange 36. Such pressure holds flange 36 downwardly into its first position against container 12 and also stabilizes bag 30 such that mouth 68 is open as depicted in FIG. 3. Item 64 is then slid into bag 30 and bag 30 is completely removed from container 12 for use. It should be noted that the user would require one hand to hold bag 30 in the position depicted in FIG. 4 and another hand to move item 64 along flange 36 while stabilizing bag 30 as shown. Thus, only two hands are required to load bag 30 utilizing system 10. FIG. 5 depicts a similar maneuver which is accomplished by the addition of support 50 which holds container 12 in the position shown on surface 56. Sandwich 58 may be prepared on surface 52 of support 50 and then slid according to directional arrow 72 onto flange 36 and into the mouth 68 of bag 30. Again, one hand of the user would be employed to slide sandwich 58 and press down slightly on flange 36 to stabilize bag 30. The other hand would hold bag 30 in an open position so that mouth 68 is positioned to accept sandwich 58 for storage.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A storage and loading system for at least one bag for use on a surface, comprising:

a. a container, said container including a wall portion forming said container further including an aperture through said wall portion for communicating with said chamber and permitting the at least one bag to egress from said chamber, said container further including a lower side lying against the surface and an upper side extending along the surface and positioned adjacent said aperture; and b. a flange, said flange being rotatably held to said container, said being flange positioned at said aperture to rotate from a first position nested to said container, to a second position extending outwardly from said aperture of said container, said flange positioned to rotate downwardly from said second position to contact the at least one bag upon extension of the at least one bag from said chamber through said aperture, and to stabilize the bag on said upper side of said container.

2. The system of claim 1 in which said flange at least partially lies within said chamber during rotational movement.

3. The system of claim 2 in which said flange overlies the at least one bag within said chamber.

4. The system of claim 3 in which said container further comprises an opening through said wall portion for allowing support of said container.

5. Th system of claim 4 in which said chamber is sized to accommodate a plurality of bags.

6. The system of claim 1 which further comprises a hollow support for holding said container relative to a surface, said container at least partially lying within said hollow container.

* * * * *